US006672589B1

(12) United States Patent
Lemke et al.

(10) Patent No.: US 6,672,589 B1
(45) Date of Patent: Jan. 6, 2004

(54) PLAYER TRACKING SYSTEM FOR GAMING TABLES

(75) Inventors: Michael L. Lemke, Henderson, NV (US); Ray Frankulin, Henderson, NV (US)

(73) Assignee: Station Casinos, Inc., Las Vegas, NV (US)

( * ) Notice: Subject to any disclaimer, the term of this patent is extended or adjusted under 35 U.S.C. 154(b) by 0 days.

(21) Appl. No.: 09/452,556

(22) Filed: Dec. 1, 1999

(51) Int. Cl.[7] ..... A63F 3/00
(52) U.S. Cl. ..... 273/236; 463/12
(58) Field of Search ..... 463/11, 12, 17, 463/13, 18, 19, 30, 31, 37, 25; 273/236, 149 R, 292, 309

(56) References Cited

U.S. PATENT DOCUMENTS 5,472,194 A * 12/1995 Breeding et al. ..... 463/27
5,586,936 A * 12/1996 Bennett et al. ..... 463/25
5,735,742 A * 4/1998 French ..... 463/25
5,775,993 A * 7/1998 Fentz et al. ..... 463/17
5,779,546 A * 7/1998 Meissner et al. ..... 463/25
5,957,776 A * 9/1999 Hoehne ..... 463/25
6,004,205 A * 12/1999 Lauretta et al. ..... 463/11
6,164,652 A * 12/2000 Lauretta et al. ..... 273/292

* cited by examiner

*Primary Examiner*—Kim Nguyen
(74) *Attorney, Agent, or Firm*—Townsend and Townsend and Crew LLP

(57) ABSTRACT

A system for tracking players at a gaming table that includes a plurality of player positions and for displaying information related to the players. The system includes a central computer, a display monitor, a card reader and an input device. The system correlates where players are seated and displays their positions along with their first names and other desirable information related to the players.

10 Claims, 5 Drawing Sheets

Seated Player

Player Closeout with Details

PLAYER TRACKING SYSTEM FOR GAMING TABLES

BACKGROUND OF THE INVENTION

1. Field of the Invention

The present invention relates to a tracking system for tracking players at a gaming table, and more particularly, to an automated player tracking system that provides a dealer with player information at player positions at the gaming table.

2. Description of the Prior Art

In the ever increasing competition among casinos to attract and retain players' loyalty, casinos generally award them with complimentary services and merchandise, which are generally referred to as "comps." Comps are similar to frequent flyer miles and are generally earned on the basis of the amount of money wagered by the player. Generally, comps are calculated on the basis of the theoretical win for the casino (or loss for the player), which in turn depends on the odds of the game and how much was wagered by the player. The theoretical win is generally fairly easy to calculate for slot machines due to their automation and ability to count each coin that is inserted and dispersed.

With table games, it is more difficult to calculate the theoretical win because bets change hands instead of being inserted into coin slots. Thus, in order to keep exact track of a player's gambling at table games, one has to capture the size of each bet and the frequency of the bets, or the number of bets per unit of time. This is typically too burdensome for casinos to do and therefore, casinos generally estimate a player's bets on the basis of the lower table betting limit and then adjusting the player's bets if the player regularly bets more, along with the speed of the game, (number of games per hour, for example). The theoretical win is then calculated on the basis of the approximate amount bet by the player and the odds for the game.

Comps have become a big point of attraction for casinos and, among other things, generally include the "free" luxury suites and similar "perks" casinos generally offer their "high roller" customers, to more mundane rewards such as free meals, merchandise, etc. offered to others. One player who walks away with a large win (resulting with a corresponding high loss to the casino) will receive the same comps as another player who incurs a loss (resulting in a win for the casino) where the two players play the same game and wager the same amount of money. Comps are often provided to players who win large amounts of money in order to entice them to remain at the casino in order to provide the casino with opportunities to win back some or all of the winnings.

Lately, major casinos including those with multiple properties, tend to issue a card to each player. This card typically has a magnetic strip that carries an ID or account number for the player as well as other relevant information. On slot machines, the player generally inserts his card into a reader attached to or incorporated in the machine and thus, all coins dropped by the player are credited to his account from which the theoretical win of the casino is calculated and then credited to the player's account at a central computer. Recently, large casinos have begun to implement multi-property wide systems where a player's gaming activity in any properties of the casinos is tracked and stored in a central account that is accessible from all casino properties.

In order to encourage players at gaming tables to remain at the table and gamble, dealers are often encouraged to strike up conversations with the players and generally be friendly with the players. This helps players feel comfortable and increases the amount of fun the players have at the table. Thus, it is beneficial for the dealers to know as much about the players on a personal level as possible in order to allow them to more easily engage in conversation with the players.

SUMMARY OF THE INVENTION

A system for tracking play at a gaming table that includes a plurality of player positions, in accordance with the present invention, includes a computer database and a single card reader adjacent a dealer position at the gaming table. The card reader is coupled to the computer database with a communication channel. A display monitor adjacent the dealer position at the table is provided that is coupled with the computer database with a communication channel and is configured to depict player positions at the gaming table. An input is coupled to the display monitor for associating a card read by the card reader with a respective player position at the table. The respective player position that is depicted by the display monitor indicates a player associated with the card read by the card reader at the respective player position.

In accordance with one aspect of the present invention, the system is configured such that the display monitor displays information associated with a player at a respective player position, either upon request or automatically.

The present invention provides a method of tracking players at gaming table that includes a plurality of player positions that include receiving a card from a player at one of the player positions, reading player information from the card with a card reader adjacent a dealer position, depicting player positions on a display adjacent the dealer position, and inputting a respective player position on the display associated with the card and the player thus indicating at which player position the player is located.

Accordingly, the present invention allows a dealer to input information from a card from a player and correlate the information contained on the card and read by the card reader with a player position. By observing a display monitor, the dealer can keep track of which players are at which player positions, and engage them in conversation by their names. This can provide a more congenial and fun atmosphere for the players, thereby encouraging them to remain at the gaming table and continue to wager money.

Furthermore, a system and method in accordance with the present invention, allows dealers and pit bosses to obtain and update information regarding players and their playing and wagering habits.

Other features and advantages of the present invention will be understood upon reading and understanding the detailed description of the preferred exemplary embodiments, found hereinbelow, in conjunction with reference to the drawings, in which like numerals represent like elements.

DETAILED DESCRIPTION OF THE PREFERRED EXEMPLARY EMBODIMENTS

Figure 1:
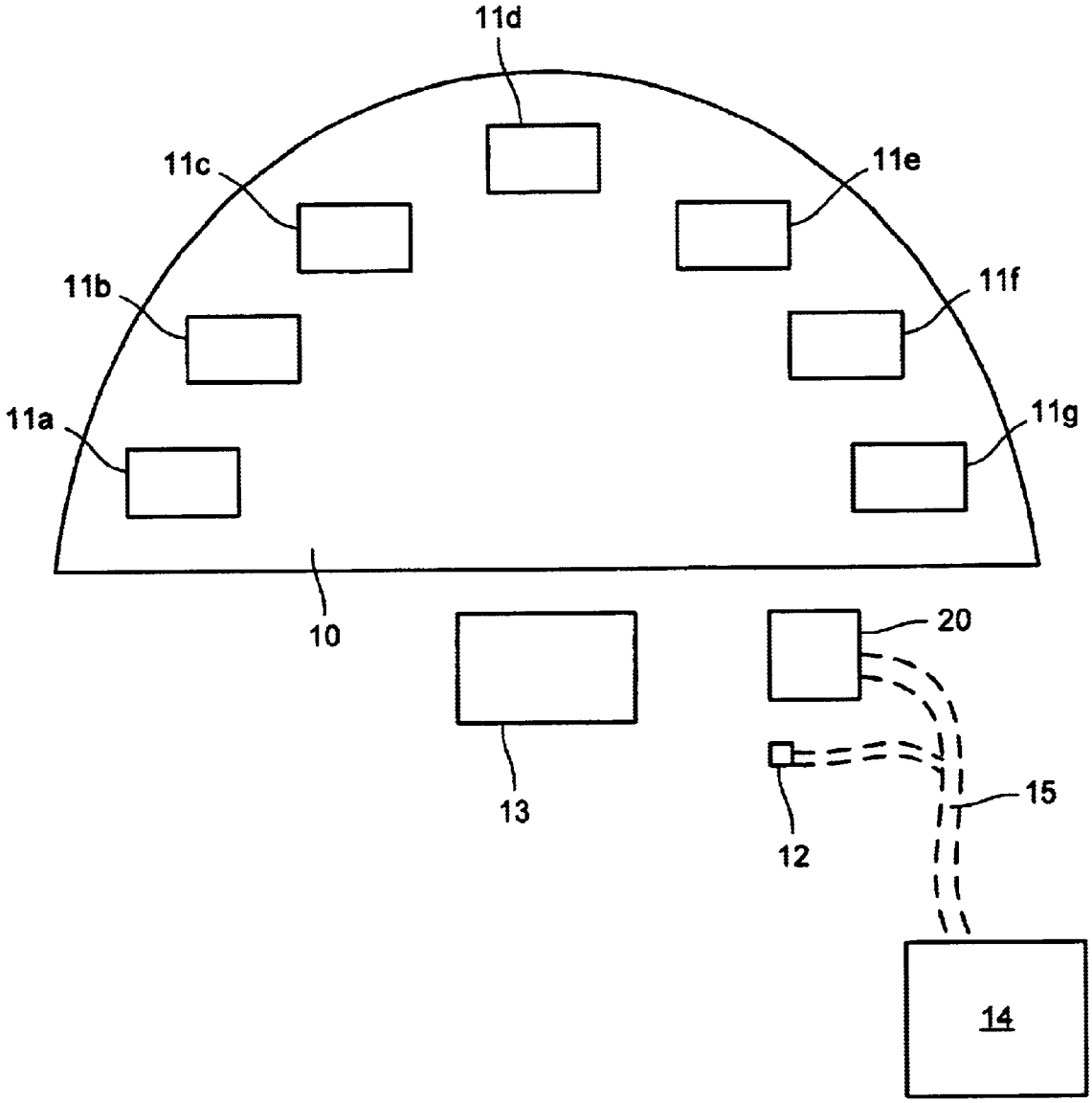
FIG. 1 is a schematic illustration of a blackjack gaming table.

A blackjack gaming table 10 is illustrated in FIG. 1. While the present invention will be described with reference to blackjack as the example game, it will be apparent to those skilled in the art that the present invention is useful for table games such as, for example, blackjack, poker, roulette, craps, and the like.

A typical blackjack table generally includes seven player positions 11*a*–11*g*. A system for tracking play of players at the blackjack table, as well as providing information pertaining to the players, includes a card reader 12 located adjacent a dealer position 13. The card reader may be any type that is capable of reading or obtaining information from cards issued by the casino, such as, for example, a magnetic reader for reading magnetic stripes on cards, an electronic card reader for reading electronic cards, and a port for receiving electronic keys.

The card reader is coupled to a central computer 14 via a communication channel 15, such as, for example, cables, wires, fiber optics, radio waves, etc. The central computer will keep track of the various players' accounts. Each player's account may include player information, such as, for example, the player's account number, the player's name, the wife's name, birthdays, anniversaries, etc.

Figure 2:
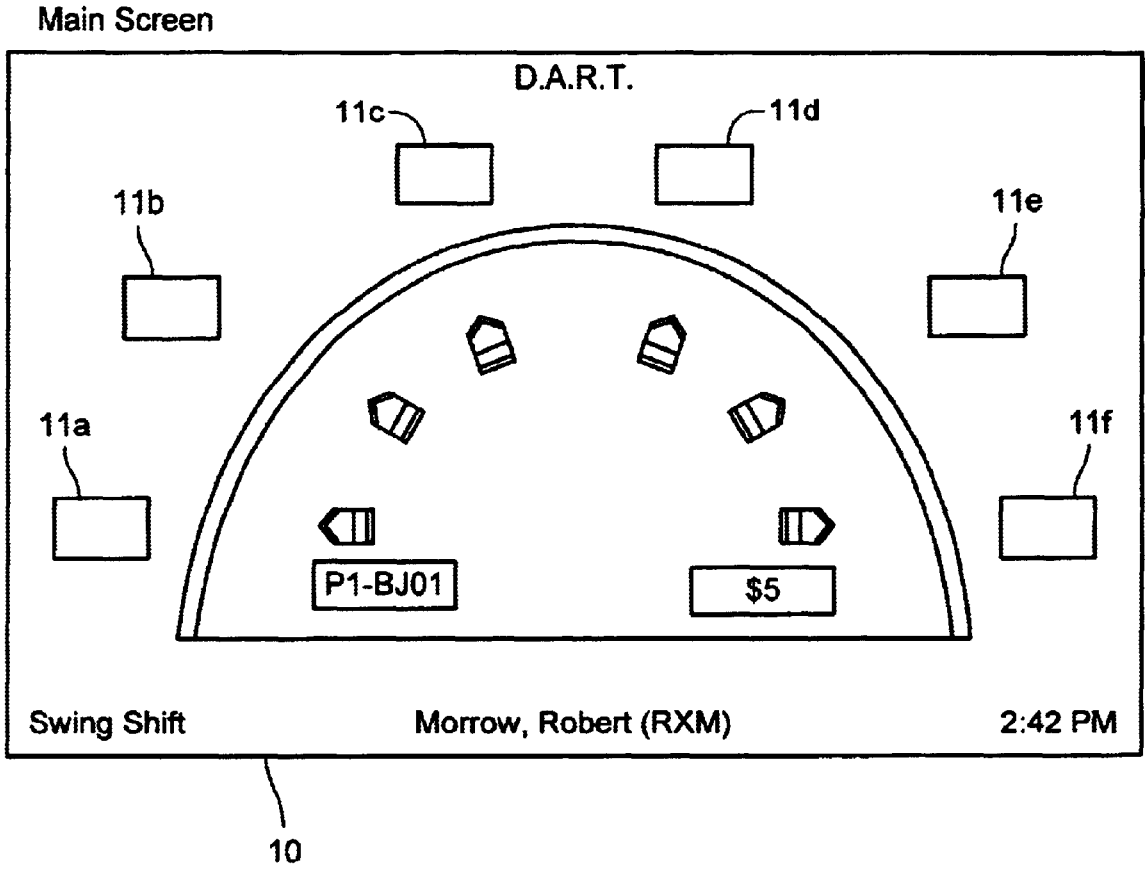
FIG. 2 is a schematic illustration of a display on a display monitor in accordance with the present invention.

The system further includes a display monitor 20. While a game is being played, the display monitor displays a picture of blackjack table 10, including all player positions 11, as illustrated in FIG. 2. Thus, after a card is read by the card reader, the dealer touches the respective player position where the player whose card has just been read is seated, thus associating the table position of the new player with the new player. Preferably, the display monitor then displays the player's name adjacent his position at the table. In a preferred embodiment, display monitor 20 includes a touch screen so that information may be input through the touch screen.

Additionally, the system may include other input devices (not shown) such as, for example, a keyboard, a mouse, and a microphone.

Figure 3:
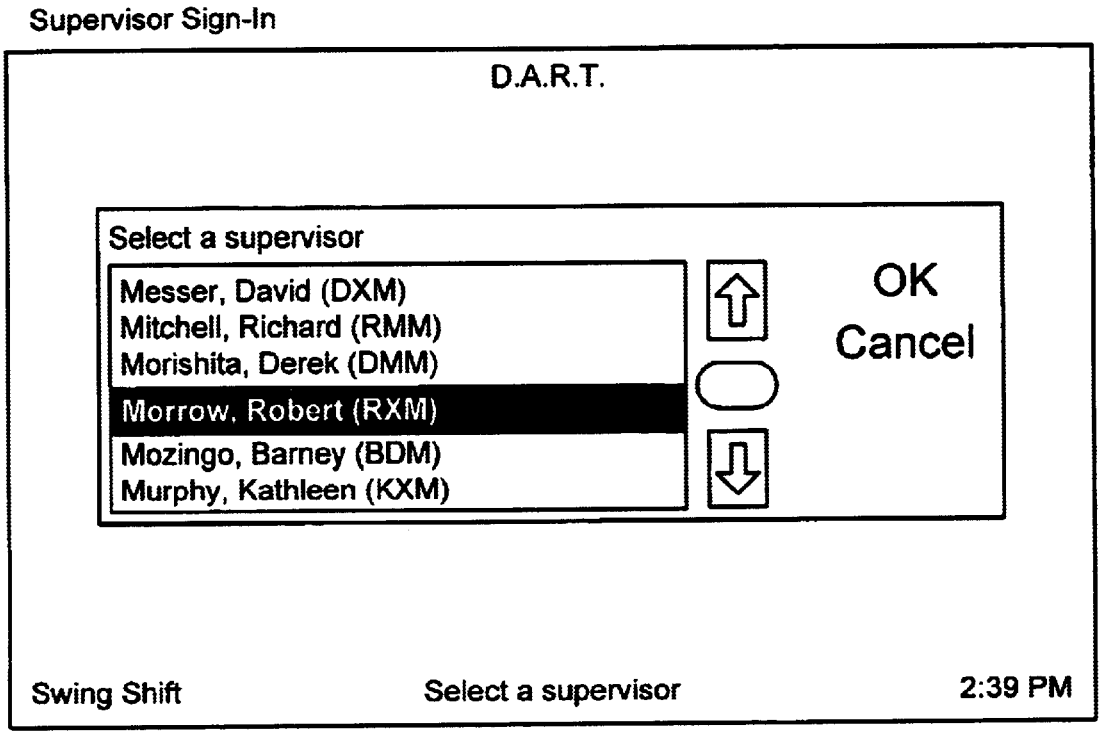
FIG. 3 is another schematic illustration of a display on a display monitor in accordance with the present invention.
Figure 4:
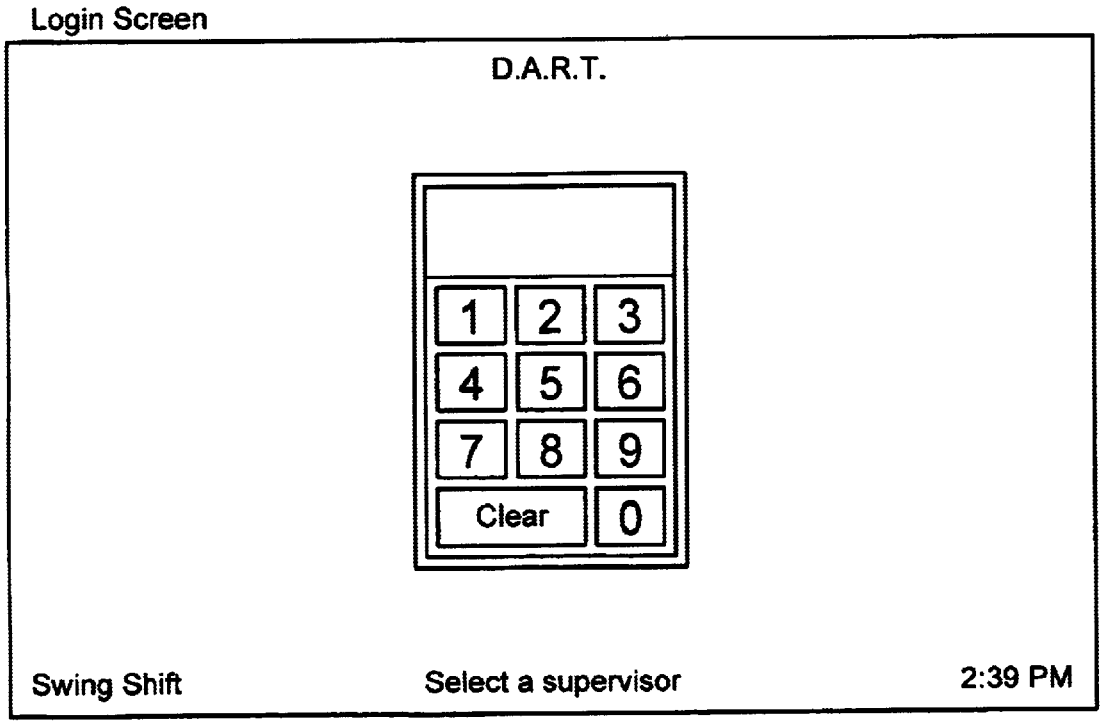
FIG. 4 is another schematic illustration of a display on a display monitor in accordance with the present invention.

In a preferred embodiment, operation of the system begins with a sign-in process. When first opening a game, a shift supervisor, or other authorized personnel, activates the system, preferably by touching the screen of the display monitor, thus turning off any screen saver present in the system. Preferably, a list of supervisors appears on the screen, as illustrated in FIG. 3, and the supervisor selects his or her name from the list. The supervisor is prompted for their individual password in order to open the game, which the supervisor provides to the system, via a screen that, for example, is similar to one illustrated in FIG. 4. The supervisor verifies that the table minimum is correct, and preferably the table maximum, and if not, changes the table setting for that game in order to reflect the actual table limits. Once the game is ready for play, the dealer assumes his position at the dealer position and players walk up to the table and present their identification devices or cards to the dealer, who then has reader 12 read them. The dealer may either keep the card or may immediately return it to the player. If the dealer keeps the card, he will obviously present it to the player when he is finished playing and wishes to leave. With such an arrangement, the dealer may, if desired, have the system re-read the card with the card reader thus signifying that the player is leaving.

Figure 5:
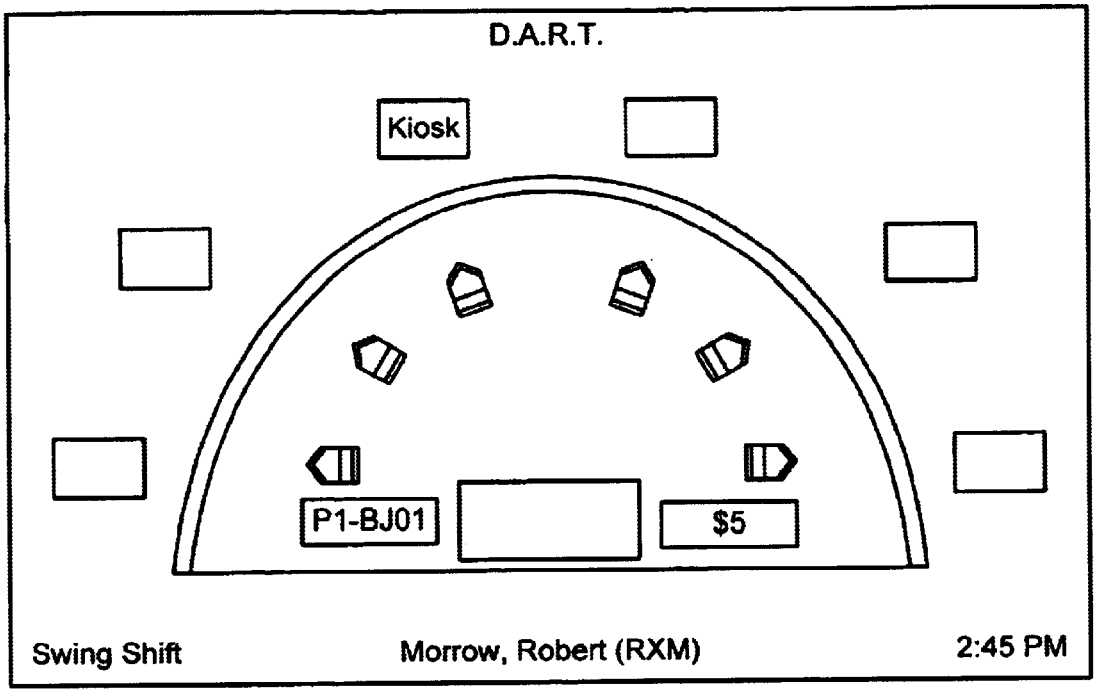
FIG. 5 is another schematic illustration of a display on a display monitor in accordance with the present invention.

After the card has been read by the card reader, the dealer inputs into the system the player position at the gaming table. As noted previously, preferably display monitor 20 is a touch screen monitor, and thus, the dealer merely touches the screen at the corresponding player position depicted thereon to indicate where the player whose card has just been read is seated. Preferably, after the dealer has input the player position at the table, the corresponding player position on the display monitor will display the player's first name, as illustrated in FIG. 5.

Preferably, central computer 14 returns information that preferably may include the player's name, any "secondarys" on the player's account (for example, his spouse), a host code corresponding to who is hosting the player (if a party is indeed hosting the player), any amount of comp dollars available, the player's birthday or anniversary, the last comp date, i.e. the last time the player was comped, and any points accumulated for any promotions or competitions with which the player is involved. This information is preferably displayed in a manner similar to that which is illustrated in FIG. 6.

Preferably, the system allows for the supervisor to enter information any time a player buys-in for his initial playing chips or whenever the player buys-in for more playing chips. Additionally, the system preferably allows the supervisor to enter the amount of chips in front of the player at various stages of the time the player spends at the playing table. Also, information is preferably input relating to the player's average bet.

Figure 6:
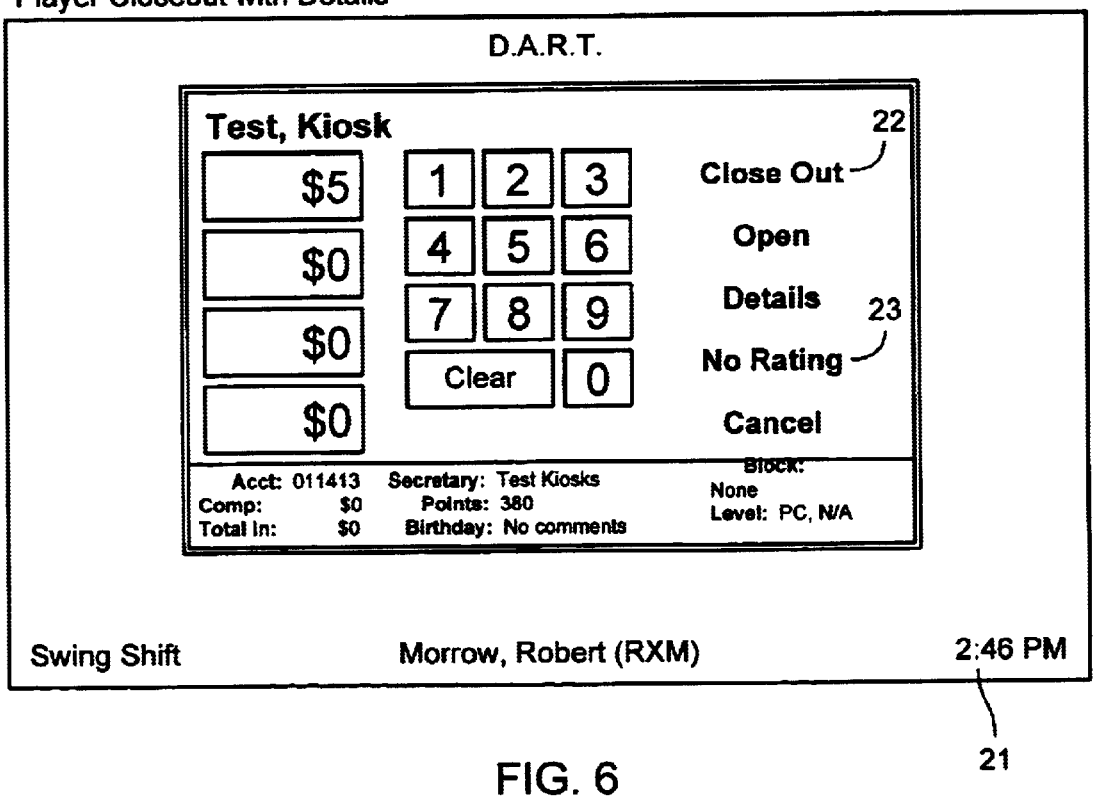
FIG. 6 is another schematic illustration of a display on a display monitor in accordance with the present invention.

As noted in FIG. 6, the system preferably includes a details key 21 on the touch screen. Such a key can be located on another input-type device if a touch screen is not used. By pressing this key, details about the player, as outlined above, may be displayed. Thus, the system may be configured to automatically display details about the player, or only display the details upon request, or both.

When a player is finished playing and wishes to leave, a "check-out" operation is preferably performed. During the check-out procedure, the supervisor preferably verifies the average bet, the speed of play, total money in, total money out and "checks," which are chips located in the player's "shoe" on the table, i.e., chips the player has but is not betting. Preferably, the supervisor, upon verification of the information, presses the appropriate key, which in a preferred embodiment is indicated by "closed rating" 22, which thereby updates the player's account with the central computer.

In a preferred embodiment, by pressing a "no rating" key 23 on the system's input, a customer will be checked out of the system, but their account will not be updated.

Figure 7:
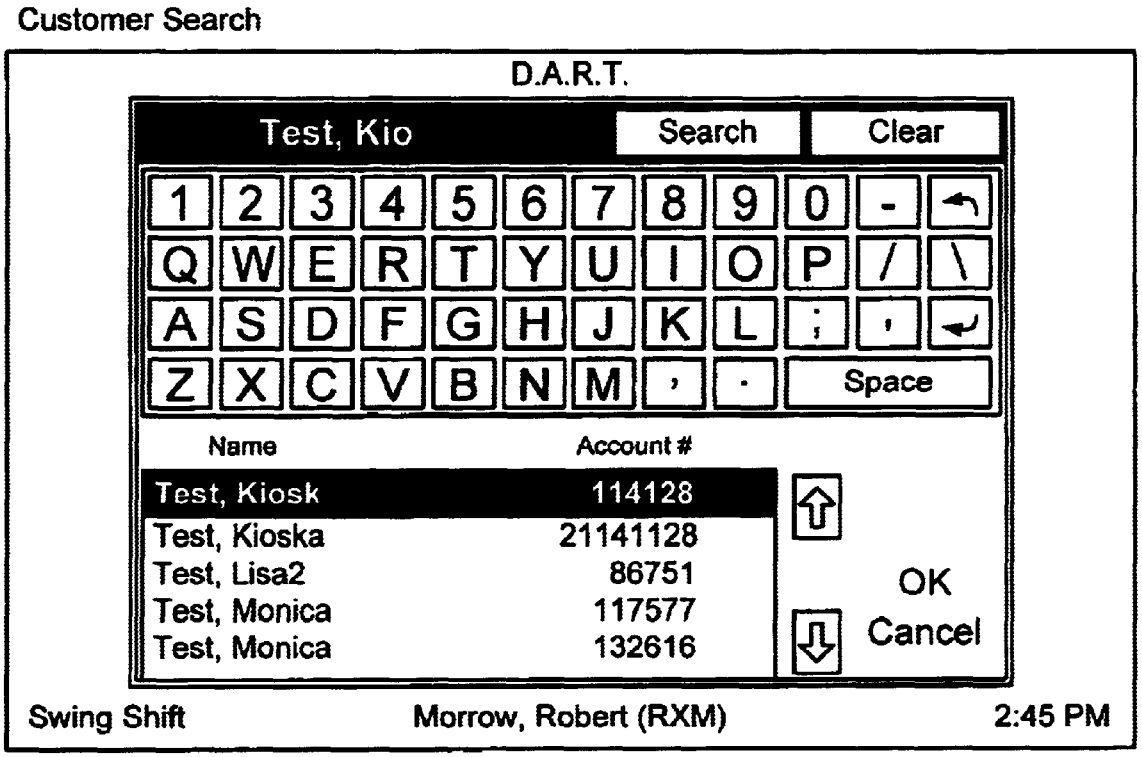
FIG. 7 is another schematic illustration of a display on a display monitor in accordance with the present invention.

A screen similar to that which is illustrated in FIG. 7 is preferably provided with the embodiment that includes a touch screen to allow for various information inputting and searching.

Although the invention has been described with reference to specific exemplary embodiments, it will be appreciated that it is intended to cover all modifications and equivalents within the scope of the appended claims.

What is claimed is:

1. A system for tracking play on a gaming table that includes a plurality of player positions, the system comprising:

a computer database;

a single card reader adjacent a dealer position at the table, the card reader being coupled to the computer database with a communication channel; and a display monitor adjacent the dealer position at the table, the display monitor being coupled to the computer database with the communication channel, the display monitor being configured to depict player positions where players are physically positioned at the table;

wherein the display monitor comprises a touchscreen for associating a card of a player being read by the card reader with a respective player position of the player at the table upon a touching of the respective player position depicted on the touchscreen, the respective player position depicted by the display monitor indicating a the player associated with the card read by the card reader.

2. A system in accordance with claim 1 wherein the system includes a game input for inputting information comprising table minimum wagers, an approximate frequency of plays for an approximate determination of an amount of money wagered by players at the table, and information regarding any players that typically wager more than the table minimum wager.

3. A system in accordance with claim 2 wherein the game input comprises a keyboard.

4. A system in accordance with claim 3 wherein the touch screen serves as the game input.

5. A system in accordance with claim 1 wherein the display monitor is configured to display information associated with the player at the respective player position upon request.

6. A system in accordance with claim 1 wherein the display monitor is configured to display information associated with the player at the respective player position automatically.

7. A method of tracking players at gaming tables that include a plurality of player positions, the method comprising:

depicting player positions at a gaming table on a display adjacent to a dealer position;

receiving and reading player information from a card of a player at the gaming table with a card reader adjacent the dealer position;

associating a respective player position of the player on the display with the card, wherein the association of the respective player position with the card is done by a dealer touching the respective player position depicted on the display when the card of the player has been read by the card reader.

8. A method in accordance with claim 7 further comprising displaying player information corresponding to the player on the display.

9. A method in accordance with claim 8 wherein the player information is displayed automatically.

10. A method in accordance with claim 8 wherein the player information is displayed upon request of the dealer.

* * * * *

UNITED STATES PATENT AND TRADEMARK OFFICE

CERTIFICATE OF CORRECTION

PATENT NO. : 6,672,589 B1
DATED : January 6, 2004
INVENTOR(S) : Michael L. Lemke et al.

It is certified that error appears in the above-identified patent and that said Letters Patent is hereby corrected as shown below:

Title page,
Item [56], References Cited, U.S. PATENT DOCUMENTS, kindly insert
-- 5,613,912 A 3/1997 Slater --; and
-- 5,809,482 A 9/1998 Strisower --

Signed and Sealed this

Sixteenth Day of March, 2004

JON W. DUDAS
*Acting Director of the United States Patent and Trademark Office*